US006513999B1

(12) United States Patent
Cismoski

(10) Patent No.: US 6,513,999 B1
(45) Date of Patent: Feb. 4, 2003

(54) LIQUID APPLICATOR

(75) Inventor: Jerry Cismoski, Chicago, IL (US)

(73) Assignee: Val-A Chicago Incorporated, Chicago, IL (US)

( * ) Notice: Subject to any disclaimer, the term of this patent is extended or adjusted under 35 U.S.C. 154(b) by 0 days.

(21) Appl. No.: 10/078,834

(22) Filed: Feb. 19, 2002

(51) Int. Cl.[7] ..... B43M 11/02
(52) U.S. Cl. ..... 401/219; 401/220; 401/219
(58) Field of Search ..... 401/219, 220, 401/213, 216, 208, 197, 193, 147

(56) References Cited

U.S. PATENT DOCUMENTS

| | | | | | |
|---|---|---|---|---|---|
| 538,297 | A | * | 4/1895 | Terry | 401/208 |
| 2,229,707 | A | | 1/1941 | Testi | |
| 2,504,189 | A | * | 4/1950 | Ehrhart et al. | 401/208 |
| 2,528,612 | A | | 11/1950 | Schildkraut et al. | |
| 2,732,575 | A | | 1/1956 | Faust | |
| 2,847,751 | A | | 8/1958 | Reed | |
| 2,932,045 | A | | 4/1960 | Rabelow | |
| 3,048,880 | A | | 8/1962 | Slomon | |
| 3,095,598 | A | | 7/1963 | Gonnella et al. | |
| 3,103,689 | A | | 9/1963 | Borisof | |
| 3,235,900 | A | | 2/1966 | Klassen | |
| 4,478,671 | A | | 10/1984 | Freeman | |
| 4,909,265 | A | * | 3/1990 | Goncalves | 132/317 |
| 4,940,350 | A | | 7/1990 | Kim | |
| 5,213,431 | A | | 5/1993 | Gentile et al. | |
| D345,501 | S | | 3/1994 | Prince | |
| 5,302,043 | A | | 4/1994 | Velliquette | |
| 5,308,182 | A | | 5/1994 | Lampert | |
| 5,934,816 | A | * | 8/1999 | Bruttomesso | 401/208 |
| 6,190,077 | B1 | | 2/2001 | Newson et al. | |
| 6,386,782 | B1 | * | 5/2002 | White, Sr. | 401/219 |

* cited by examiner

*Primary Examiner*—Steven O Douglas
*Assistant Examiner*—Huyen Le
(74) *Attorney, Agent, or Firm*—Ladas & Parry

(57) ABSTRACT

A roller-type liquid applicator which has a roller, roller support and a reservoir. Liquid is added to the reservoir and is dispensed through an opening onto the roller. The roller is held in place adjacent to the opening by the roller support which allows the roller to freely rotate. A chamber is formed between the external surface of the opening and the inner surface of the roller support. The chamber serves the purpose of collecting excess liquid which is not transferred from the roller onto the application surface, and which could otherwise collect in and around the opening, eventually drying and preventing the proper functioning of the applicator.

10 Claims, 5 Drawing Sheets

LIQUID APPLICATOR

BACKGROUND OF THE INVENTION

1. Field of the Invention

The invention relates generally to a liquid applicator, and, more particularly to a roller-type applicator for use with liquid adhesives having a chamber which collects excess adhesive, which may dry and impede the proper functioning of the applicator.

2. Background Art

Various devices for dispensing and applying liquids by means of a roller-type applicator are well known in the art. These devices typically have a spherical or cylinder shaped roller which rotates, the liquid being dispensed from a valve onto the roller surface, and therefrom onto the surface which the liquid is to be applied. The surface of the roller may also have recesses which measure the amount of the applied liquid which is dispensed as the roller rotates past the valve.

When using such a device for the application of liquid adhesives, a problem that is typically encountered is that excess adhesive builds up and dries around the roller and the valve thereby preventing the proper functioning of the device. If this excess adhesive is allowed to dry completely, the device may then become inoperable.

A partial solution to this problem is to make the liquid applicator so that it may be easily disassembled and cleaned. This allows the applicator to be cleaned during a large application job and between uses.

U.S. Pat. No. 5,302,043 discloses a roller type liquid applicator which has a roller support which is removable from the liquid reservoir, and which allows for the removal of the roller, for the easy cleaning of each.

U.S. Pat. No. 3,048,880 also discloses a roller type liquid applicator which may be easily disassembled for cleaning.

However, no liquid applicator device has previously solved the problem of extending the time which the applicator may be used with an adhesive or other liquid before the liquid dries and impedes the use of the device, and the constant need to clean the device.

The liquid applicator described herein is able to fulfill this before described need, extending the useful time of the applicator when used with an adhesive or other liquid before it requires to be cleaned to maintain proper functioning. This new liquid applicator is able to solve the problem by collecting excess liquid on the roller that would usually collect in and around the dispensing opening and the roller away from the dispensing opening, allowing the applicator to continue to function without being impeded by this excess liquid that would eventually dry and clog the dispensing opening.

SUMMARY OF THE INVENTION

A roller-type liquid applicator that allows an extended time of continuous use when applying adhesives or other liquids that may dry and impeded the proper functioning of the applicator. This liquid applicator has a chamber surrounding the dispensing opening through which the liquid passes onto the applicator roller. Excess liquid collects in this chamber, away from the dispensing opening, when the applicator is used, thereby preventing the excess liquid which is not transferred from the roller onto the applicator surface and remains on the roller from collecting and drying in the dispensing opening and impeding the proper functioning of the applicator.

The invention provides A roller-type liquid applicator comprising a liquid reservoir including a wall defining an inner surface and an outer surface, said wall having an opening for dispensing liquid from the reservoir outwardly through the opening, a roller support adjacent to said opening, connected to said wall of the liquid reservoir, having internal and external surfaces and a rotational support member, a roller mounted for rotation and supported by said rotational support member and positioned so that an outer circumferential surface of said roller rotates closely adjacent to said opening, and a chamber defined by the outer surface of the wall of said liquid reservoir, the internal surface of the roller support, and the outer circumferential surface of the roller, so that excess liquid dispensed from the liquid reservoir and not deposited on an applicating surface by said roller, is collected within said chamber as said roller circumferential surface rotates closely adjacent said opening in the liquid reservoir.

DETAILED DESCRIPTION OF THE PREFERRED EMBODIMENTS

Figure 1:
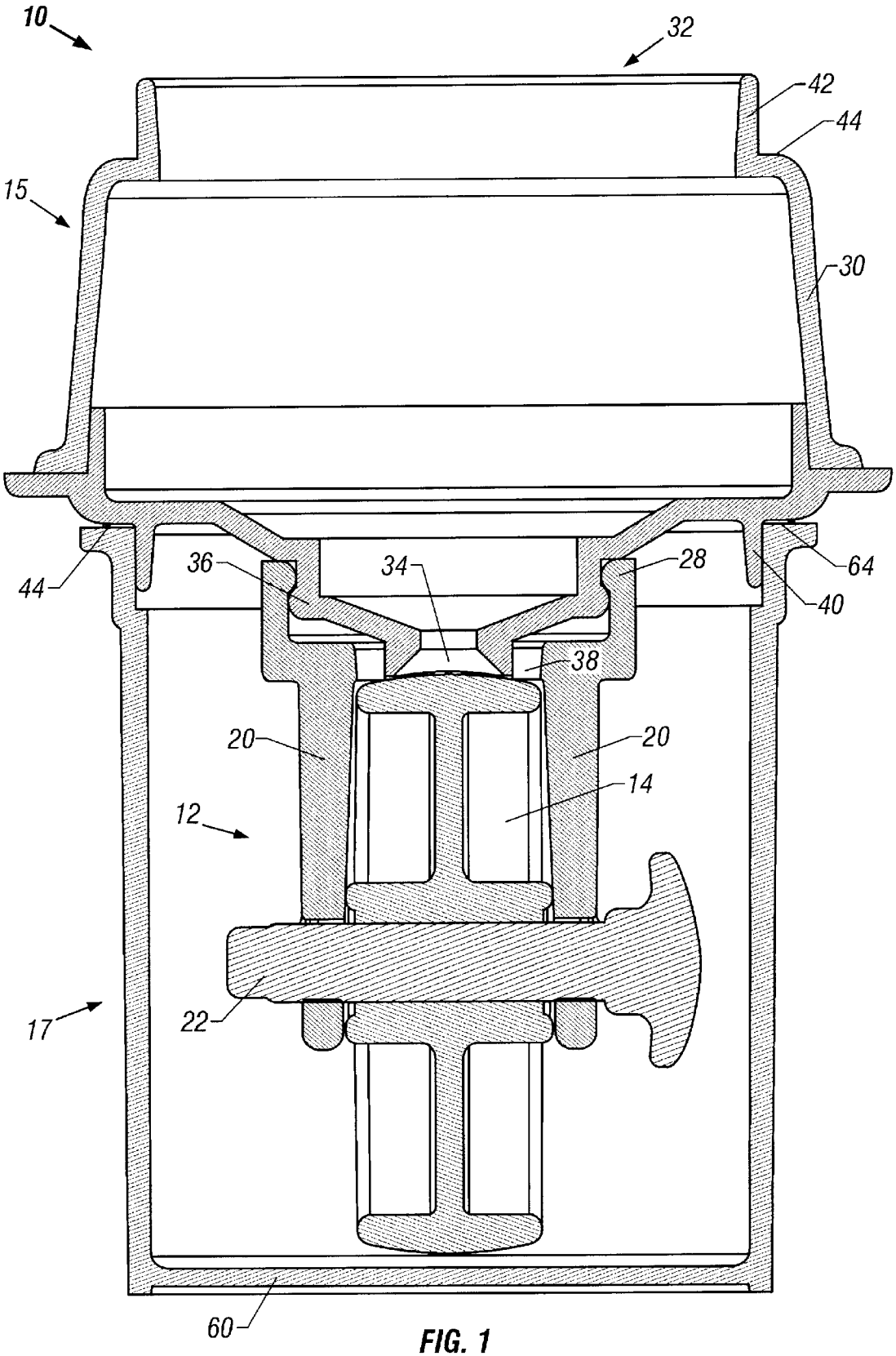
FIG. 1 is a cross-sectional view of the assembled components of the present invention.
Figure 2:
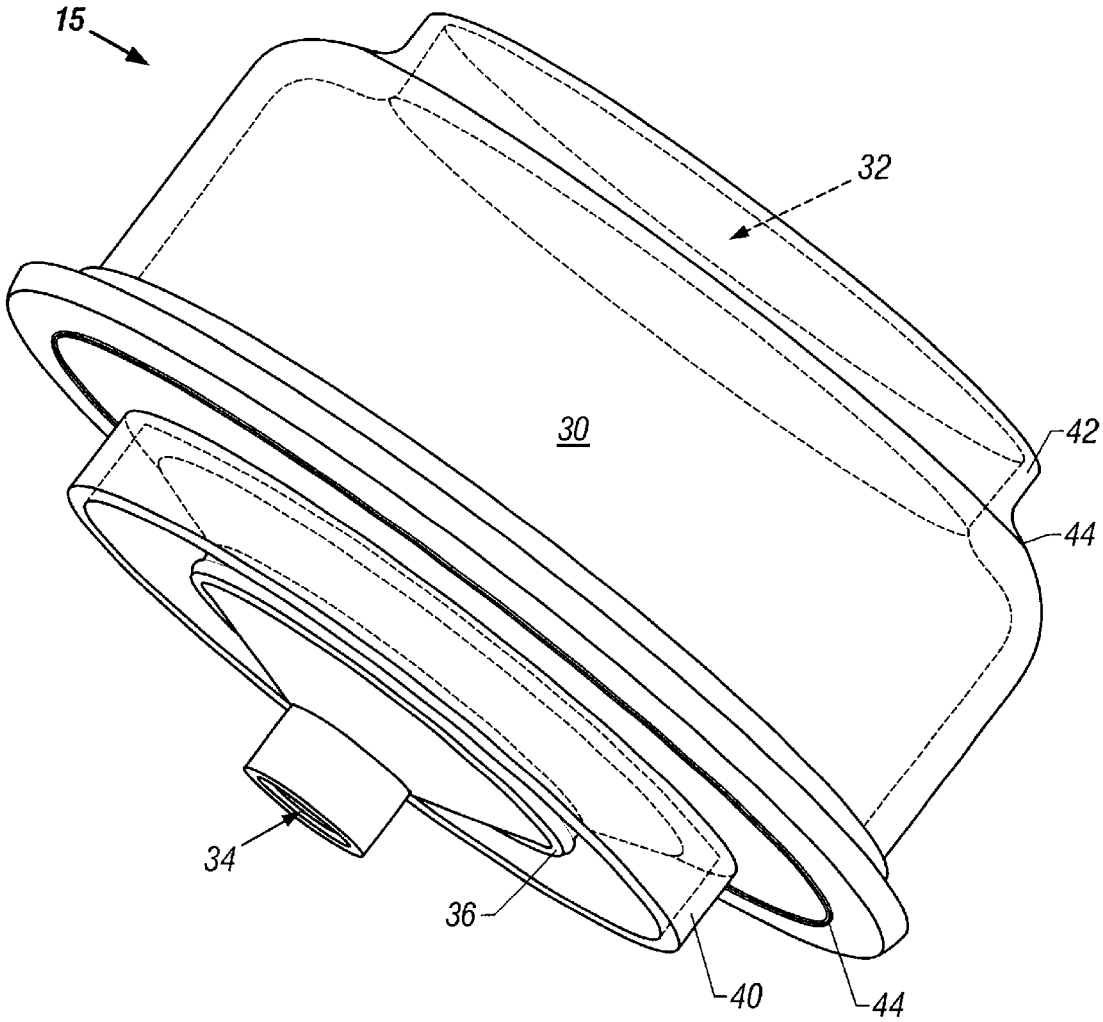
FIG. 2 is a perspective view of the reservoir portion.

As shown in the figures, the adhesive applicator 10 has three separate components: a roller portion 12, a reservoir portion 15, and a cup 17. The preferred embodiment of the invention is described below.

The roller portion 12 has a roller 14 which has a plurality of recesses 16 within the radial surface 18 of the roller 14. The recesses 16 serve the purpose of dispensing out a measured amount of liquid as the roller 14 is rolled upon the surface on which the liquid is to be applied. Two supports 20 extend along either side of the roller 14.

Figure 3:
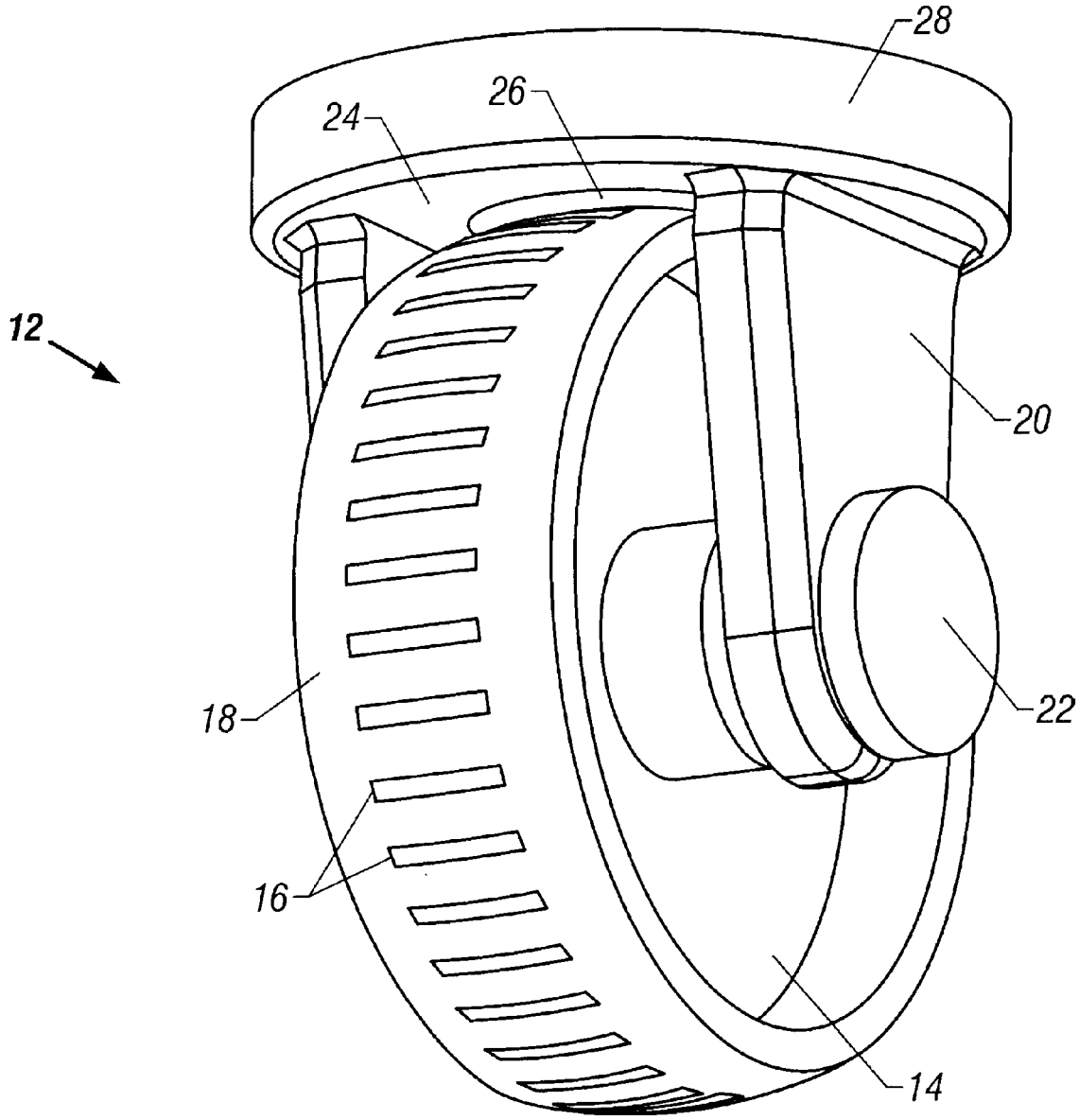
FIG. 3 is a perspective view of the roller portion.
Figure 4:
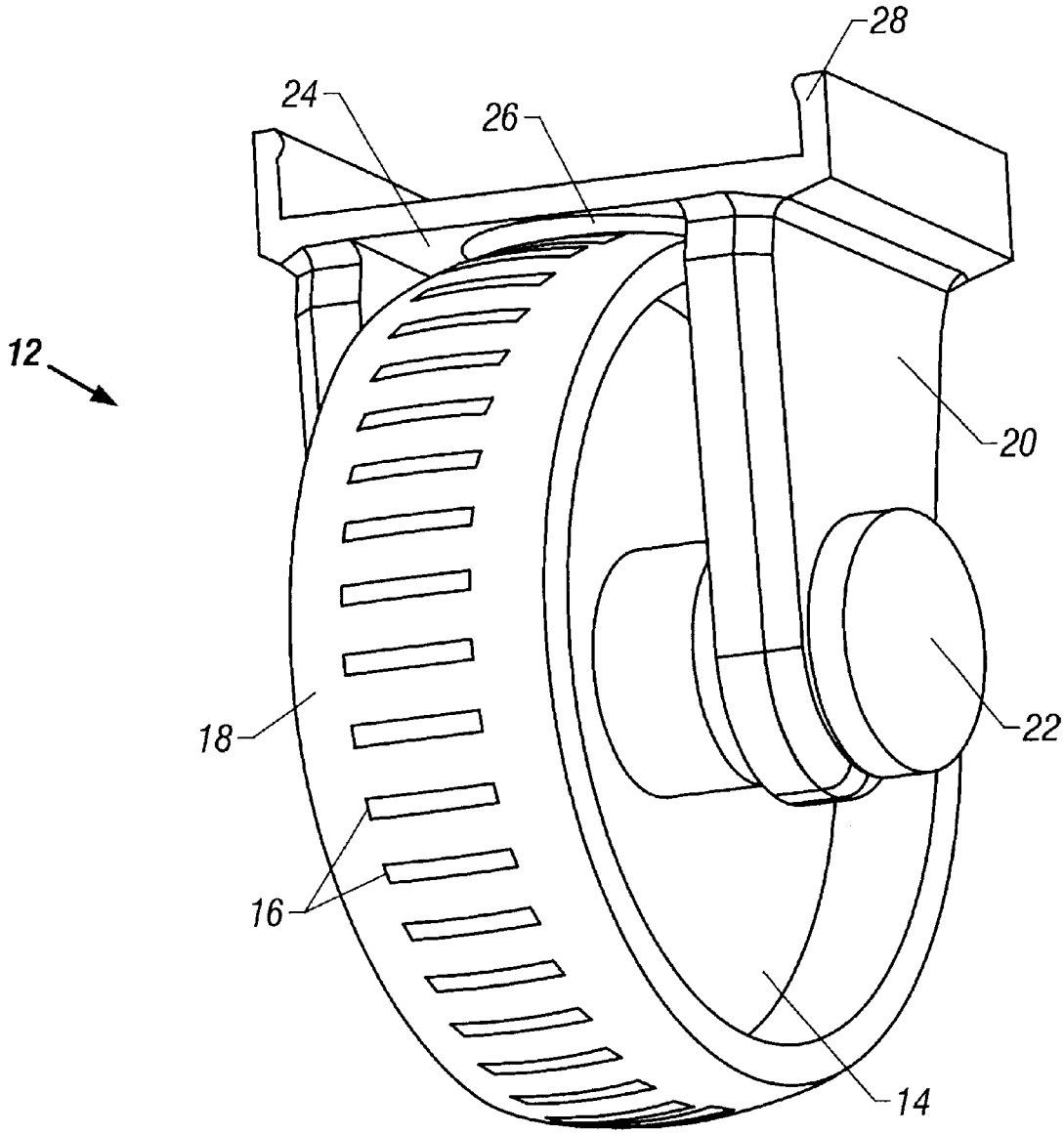
FIG. 4 is a perspective view of another embodiment of the roller portion.
Figure 5:
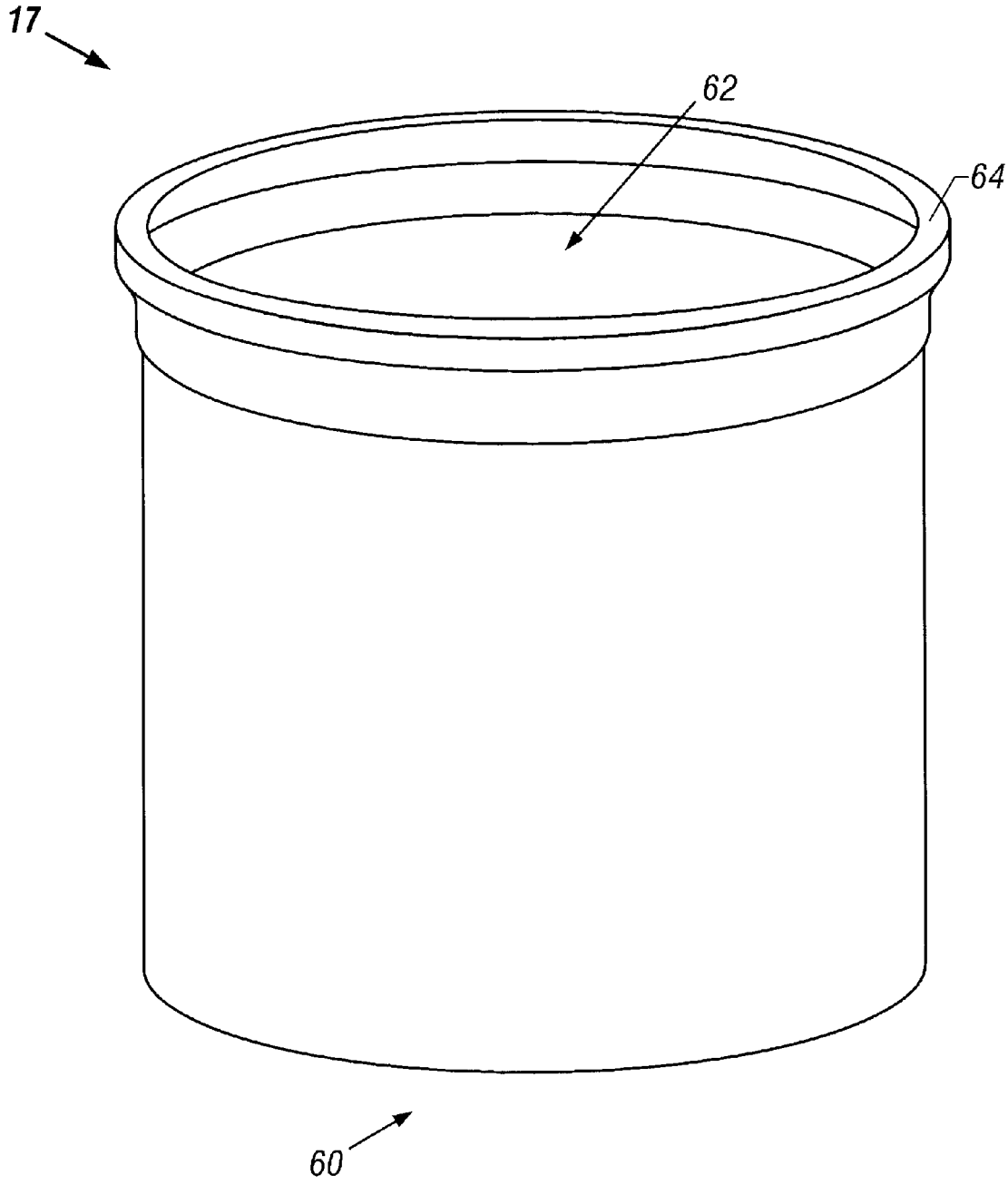
FIG. 5 is a perspective view of the top portion.

A pin 22 is inserted through each of the supports 20 and the center of the roller 14, the roller 14 able to rotate freely about the pin 22. The supports 20 are rigidly connected to each other by a connecting surface 24, the connecting surface 24 coming within close contact with the radial surface 18 of the roller 14 where an aperture 26 is provided in the connecting surface 24. This aperture is preferably circular in shape. The supports 20 extend past the connecting surface 24 and form a lip 28. Even more preferred, as shown in FIG. 3, the lip 28 extends between the supports 20 in a circular shape.

The roller 14 may take various shapes such as a cylinder or a sphere. The roller may also be supported by the supports 20 with or without the use of a pin 22. If the roller 14 takes the shape of a sphere and is mounted between the supports 20 without a pin, the roller may then rotate freely, and not about a defined axis of rotation.

The reservoir portion 15 has a side wall 30 with a reservoir opening 32 on one end through the side wall 30 through which liquid may be added to the reservoir portion 15. At the other end of the reservoir portion 15, the side wall 30 converges to form an applicator dispensing opening 34. The side wall 30 of the reservoir portion has a lip 36 which when the reservoir portion 15 and the roller portion 12 are pressed together, the lip 36 of the reservoir portion will contact and connect with the lip 28 of the roller portion 12, thereby forming a removable sealing connection between the reservoir portion 15 and the roller portion 12 at their respective lips 36, 28. However, this snap-fit connection is not intended to be the only means of connecting the reservoir portion to the roller portion, other connection means, such as a screw-fit type of connection, being obvious to those skilled in the art.

The external surface of the side wall 30 at the applicator dispensing opening 34 extends such that when the roller portion 12 and reservoir portion 15 are connected together, the external surface of the applicator dispensing opening 34 extends through the aperture 26 in the connecting surface 24 of the roller portion, so that the applicator dispensing opening 34 comes within close contact with the roller 14. The applicator dispensing opening 34 is wide enough to provide liquid coverage to each of the recesses 16 of the roller 14 of liquid passing through the applicator dispensing opening 34, as the wheel rotates. A chamber 38 is formed between the external surface of the side wall 30 at the applicator dispensing opening 34 and the aperture 24 in of the connecting surface.

The reservoir portion 15 preferably has a flange 40 extending from the side walls 30 opposite and away from a flange 42 disposed around the opening 32 of the reservoir portion. The flange 40 has the same outer dimensions as the flange 42. The edge of the reservoir opening 32 is preferably recessed in from the side walls 30 of the reservoir portion, ledges 44 preferably being formed between the side walls 30 and the flange 42 of the reservoir opening 32, and the side walls and the flange 40.

The cup portion 17 has a closed bottom 60 and open top 62. The open top 62 of the cup portion 16 is large enough to closely fit around and engage the outer surfaces of the flange 42 or the flange 40. When the flange 40 or flange 42 is inserted through the open top 62 of the cup portion 17, the corresponding ledge 44 comes in contact with the top edge 64 of the cup portion 17, and supports the reservoir portion 15 over the open top 62. The side walls 66 of the cup portion 17 are preferably high enough so that the roller portion 12 may fit within the cup portion 17, when the reservoir portion 15 is connected to roller portion 12, and the flange 40 is inserted within the open top 62 of the cup portion 17.

The advantage of the above described invention is that when the applicator is used to apply a liquid, especially adhesives, the time that the applicator may be used before the dispensing opening becomes clogged is extended. During use, liquid which is not transferred from the roller onto the application surface collects in the chamber formed between the external surface of the dispensing opening and the support connecting surface. The excess liquid which is collected in the chamber would otherwise collect in and around the dispensing opening. This excess liquid eventually dries, and if collected in and around the dispensing opening, prevents the proper functioning and dispensing of liquid through the dispensing opening.

Therefore, it can be seen that the described invention is particularly useful when used with fast drying liquids during extended application jobs.

Once the dispensing opening does begin to clog, and after the use of the applicator has been completed, the applicator may be easily disassembled for cleaning by disconnecting the reservoir portion from the roller portion and further disassembling the roller portion by removing the pin and roller from the supports.

The adhesive applicator of the present invention may be modified in several ways including, but not limited to, varying the shape of the roller, recesses, dispensing opening external surface, and aperture of the connecting surface, modifying the type of connection between the reservoir portion and roller portion, and modifying the support structure.

What is claimed is:

1. A roller-type liquid applicator comprising:

a liquid reservoir including a wall defining an inner surface and an outer surface, said wall having an opening for dispensing liquid from the reservoir outwardly through the opening;

a roller support adjacent to said opening, connected to said wall of the liquid reservoir, having internal and external surfaces and a rotational support member;

a roller mounted for rotation and supported by said rotational support member and positioned so that an outer circumferential surface of said roller rotates closely adjacent to said opening; and a chamber defined by the outer surface of the wall of said liquid reservoir, the internal surface of the roller support, and the outer circumferential surface of the roller, so that excess liquid dispensed from the liquid reservoir and not deposited on an applicating surface by said roller, is collected within said chamber as said roller circumferential surface rotates closely adjacent said opening in the liquid reservoir; and wherein said roller support and said outer surface of the wall of the reservoir are provided with a snap-fit connection for removably connecting said roller support to said outer surface of the wall of the reservoir.

2. The roller-type liquid applicator of claim 1 wherein said roller is cylindrically shaped and wherein said applicator further includes an axial pin passing through a center of said roller and said rotational support member.

3. The roller-type liquid applicator of claim 2 wherein said axial pin is removable, thereby allowing the roller to be easily disassembled from the roller support.

4. The roller-type liquid applicator of claim 2 wherein said outer circumferential surface of said roller is outwardly convex and said opening of the wall has a circular shape defined by a rim such that the rim of the reservoir wall defining said opening and said circumferential surface of said roller engage each other.

5. The roller-type liquid applicator of claim 1 wherein said outer circumferential surface of the roller has a plurality of recesses.

6. The roller-type liquid applicator of claim 1 wherein said snap-fit connection is a removable sealing connection.

7. The roller-type liquid applicator of claim 1 further comprising:

a first flange member extending from the outer surface of said reservoir having outer and inner first flange surfaces; and a cup having an inner cup surface for engaging with said outer first flange surface, said cup being sized, dimensioned and configured so as to completely contain said roller and said roller support when said roller support is connected to the outer wall of the reservoir.

8. The roller-type liquid applicator of claim 7 wherein said reservoir further comprises a reservoir intake opening, removed from said reservoir wall opening, into which liquid may be added into the reservoir.

9. The roller-type liquid applicator of claim 8 further comprising a second flange member extending from the outer surface of said reservoir having outer and inner second flange surfaces, said outer second flange surface being sized, dimensioned and configured to permit engagement with said inner cup surface.

10. The roller type liquid applicator of claim 9 wherein said second flange member is disposed around and defines said reservoir intake opening.

* * * * *